US011424540B2

(12) United States Patent
Tang

(10) Patent No.: US 11,424,540 B2
(45) Date of Patent: Aug. 23, 2022

(54) ANTENNA SYSTEM

(71) Applicant: PCI Private Limited, Singapore (SG)

(72) Inventor: Wee Hua Tang, Singapore (SG)

(73) Assignee: PCI Private Limited, Singapore (SG)

( * ) Notice: Subject to any disclaimer, the term of this patent is extended or adjusted under 35 U.S.C. 154(b) by 39 days.

(21) Appl. No.: 17/072,690

(22) Filed: Oct. 16, 2020

(65) Prior Publication Data

US 2021/0126370 A1 Apr. 29, 2021

(30) Foreign Application Priority Data

Oct. 24, 2019 (SG) ..... 10201909947Y

(51) Int. Cl.

| | |
|---|---|
| ***H01Q 9/04*** | (2006.01) |
| ***H01Q 19/00*** | (2006.01) |
| ***H01P 5/16*** | (2006.01) |
| ***H01Q 1/48*** | (2006.01) |

(52) U.S. Cl.

CPC ..... *H01Q 9/0414* (2013.01); *H01P 5/16* (2013.01); *H01Q 1/48* (2013.01); *H01Q 19/005* (2013.01); *H01Q 9/0435* (2013.01)

(58) Field of Classification Search

CPC ..... H01Q 9/04; H01Q 9/0407; H01Q 9/0414; H01Q 9/0428; H01Q 9/0435; H01Q 19/005

See application file for complete search history.

(56) References Cited

U.S. PATENT DOCUMENTS

| | | | | |
|---|---|---|---|---|
| 4,835,538 A * | 5/1989 | McKenna | H01Q 9/0414 343/700 MS |
| 5,515,057 A | 5/1996 | Lennen et al. | |
| 5,627,550 A | 5/1997 | Sanad | |
| 5,703,601 A | 12/1997 | Nalbandian et al. | |
| 5,861,848 A | 1/1999 | Iwasaki | |
| 5,872,547 A | 2/1999 | Martek | |
| 5,995,047 A * | 11/1999 | Freyssinier | H01Q 21/065 343/846 |
| 6,127,987 A | 10/2000 | Maruyama et al. | |
| 6,166,692 A | 12/2000 | Nalbandian et al. | |
| 6,236,367 B1 | 5/2001 | Du Toit et al. | |

(Continued)

FOREIGN PATENT DOCUMENTS

| | | |
|---|---|---|
| CN | 102332637 A | 1/2012 |
| CN | 104300203 A | 1/2015 |

(Continued)

OTHER PUBLICATIONS

Official Action in reference to related Singapore Application No. 10201909947Y filed Oct. 24, 2019.

(Continued)

*Primary Examiner* — Jason Crawford

(74) *Attorney, Agent, or Firm* — Dinsmore & Shohl, LLP

(57) ABSTRACT

An antenna system includes a first substrate, the first substrate being a dielectric substrate, a first patch on a first surface of the dielectric substrate and a second patch on a second surface of the dielectric substrate. The first and second patches are coupled to form a first capacitor with the dielectric substrate. A second substrate is coupled to the first substrate and a ground layer is provided on a first surface of the second substrate. An antenna feed is coupled to the second substrate.

9 Claims, 14 Drawing Sheets

(56) References Cited

U.S. PATENT DOCUMENTS

| | | | | |
|---|---|---|---|---|
| 6,252,553 | B1 | 6/2001 | Solomon | |
| 6,320,546 | B1 * | 11/2001 | Newton | H01Q 21/065 343/700 MS |
| 6,462,710 | B1 * | 10/2002 | Carson | H01Q 21/065 343/770 |
| 6,897,809 | B2 * | 5/2005 | Carson | H01Q 5/40 343/846 |
| 2003/0030594 | A1 | 2/2003 | Larry | |
| 2003/0043084 | A1 | 3/2003 | Egashira | |
| 2003/0052825 | A1 | 3/2003 | Rao et al. | |
| 2003/0146872 | A1 | 8/2003 | Kellerman et al. | |
| 2005/0110683 | A1 | 5/2005 | Song et al. | |
| 2005/0110688 | A1 | 5/2005 | Balliarda et al. | |
| 2007/0052587 | A1 | 3/2007 | Cheng | |
| 2007/0126638 | A1 * | 6/2007 | Channabasappa | H01Q 9/0407 343/700 MS |
| 2008/0129636 | A1 | 6/2008 | Surittikul et al. | |
| 2009/0058731 | A1 | 3/2009 | Geary et al. | |
| 2009/0278746 | A1 | 11/2009 | Aurinsalo et al. | |
| 2012/0026043 | A1 | 2/2012 | Rida et al. | |
| 2012/0242547 | A1 * | 9/2012 | Fujii | H01Q 1/38 343/700 MS |
| 2015/0091760 | A1 * | 4/2015 | Sawa | H01Q 5/385 343/700 MS |
| 2015/0380825 | A1 | 12/2015 | Ryu et al. | |
| 2016/0156105 | A1 | 6/2016 | Buckley | |
| 2016/0261047 | A1 * | 9/2016 | Wallace | G01S 19/32 |
| 2021/0126370 | A1 * | 4/2021 | Tang | H01Q 9/0414 |

FOREIGN PATENT DOCUMENTS

| | | | |
|---|---|---|---|
| CN | 107369893 | A | 11/2017 |
| EP | 01088087 | A1 | 11/1985 |
| GB | 2561445 | A | 2/2018 |
| JP | 2003258533 | A | 9/2003 |
| WO | 2018004684 | A1 | 1/2018 |
| WO | 2018210054 | A1 | 11/2018 |

OTHER PUBLICATIONS

International Search Report in reference to co-pending European Patent Application No. 20201589.7 filed Mar. 23, 2021.

Sanad, "A Compact Dual-Broadband Microstrip Antenna Having Both Stacked and Planar Parasitic Elements", International Symposium, pp. 6-9, Jul. 21, 1996, XP000782135.

* cited by examiner

ANTENNA SYSTEM

CROSS-REFERENCES TO RELATED APPLICATIONS

This application claims the benefit of priority under 35 U.S.C. § 119 to Singapore Patent Application No. 10201909947Y, filed Oct. 24, 2019, which application is incorporated by reference herein in its entirety.

TECHNICAL FIELD

The present application relates to the field of telecommunications and more particularly to an antenna system.

BACKGROUND

Satellite navigation and WiFi communications are both useful radio technologies with numerous applications. However, in certain applications such as, for example, the maritime sector, there are no antennas that cover network bands for both satellite navigation and WiFi communications. It is therefore desirable to provide an antenna system that is operable for both satellite navigation and WiFi communications.

SUMMARY

Accordingly, in a first aspect, the present application provides an antenna system including a first substrate, the first substrate being a dielectric substrate, a first patch on a first surface of the dielectric substrate and a second patch on a second surface of the dielectric substrate. The first and second patches are coupled to form a first capacitor with the dielectric substrate. A second substrate is coupled to the first substrate and a ground layer is provided on a first surface of the second substrate. An antenna feed is coupled to the second substrate.

Other aspects and advantages will become apparent from the following detailed description, taken in conjunction with the accompanying drawings, illustrating by way of example the principles of the invention.

BRIEF DESCRIPTION OF THE DRAWINGS

Embodiments will now be described, by way of example only, with reference to the accompanying drawings, in which.

DETAILED DESCRIPTION

Figure 1A:
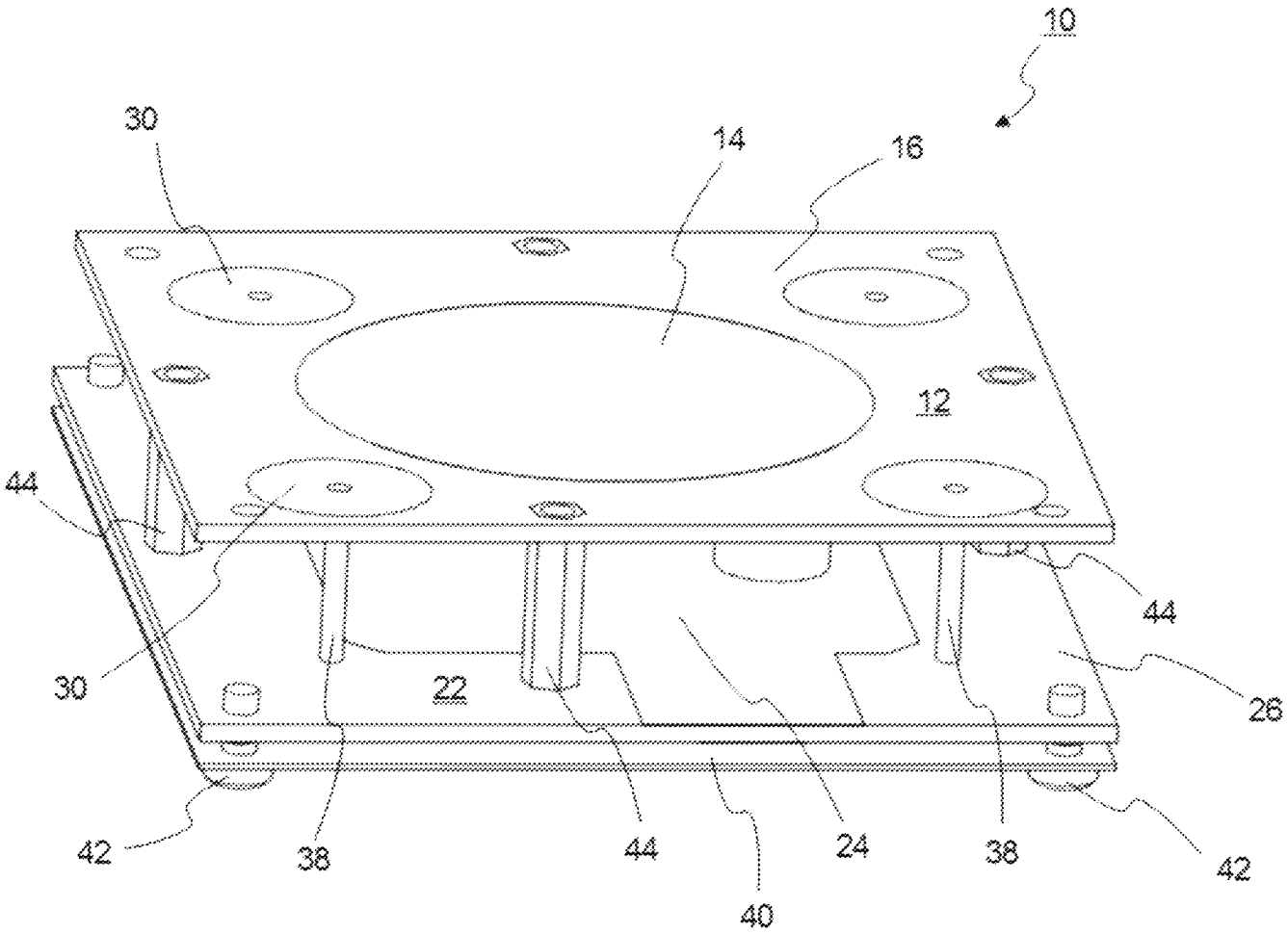
FIG. 1A is a schematic perspective view of an antenna system in accordance with an embodiment herein.
Figure 1B:
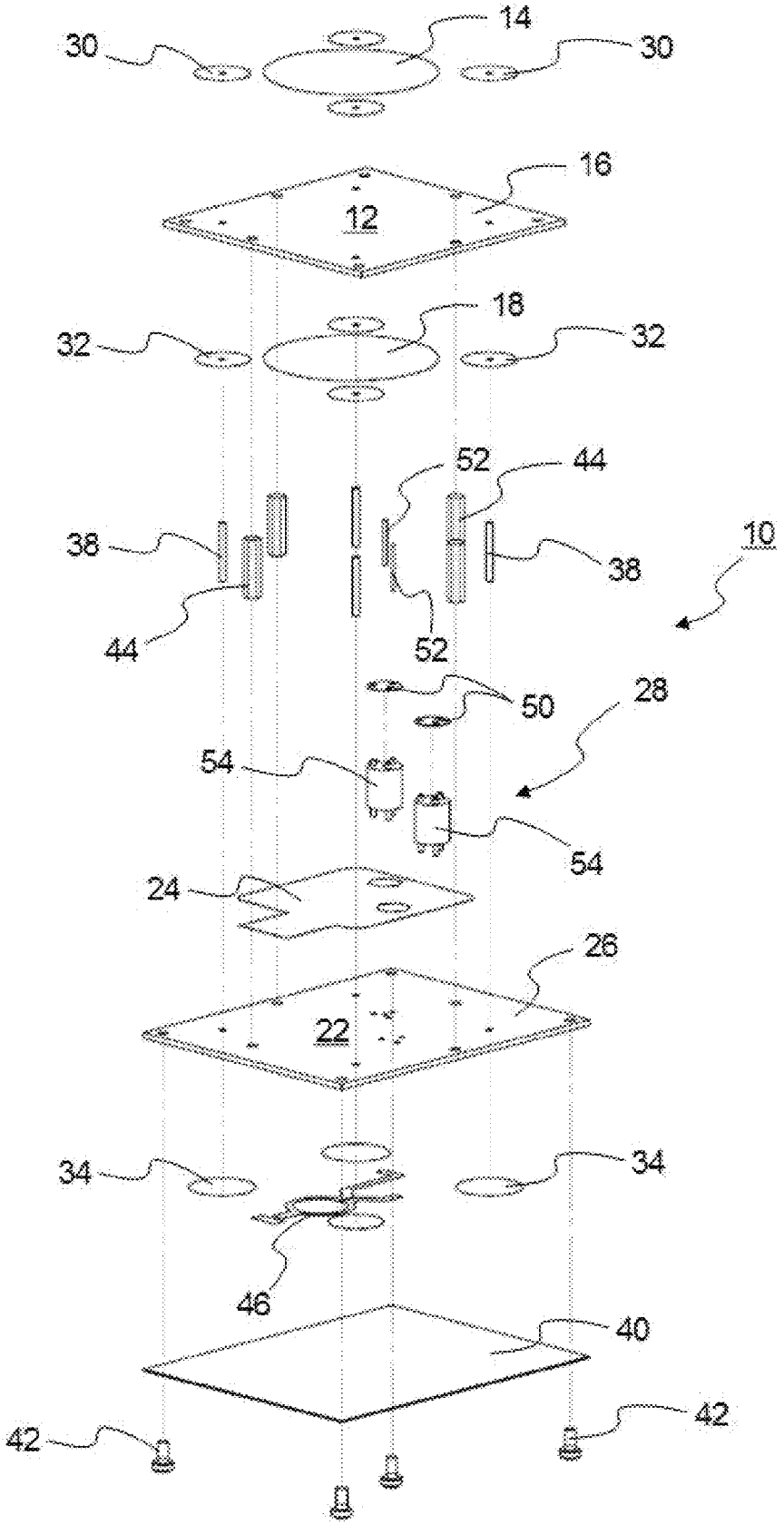
FIG. 1B is an exploded schematic perspective view of the antenna system of FIG. 1A.
Figure 1C:
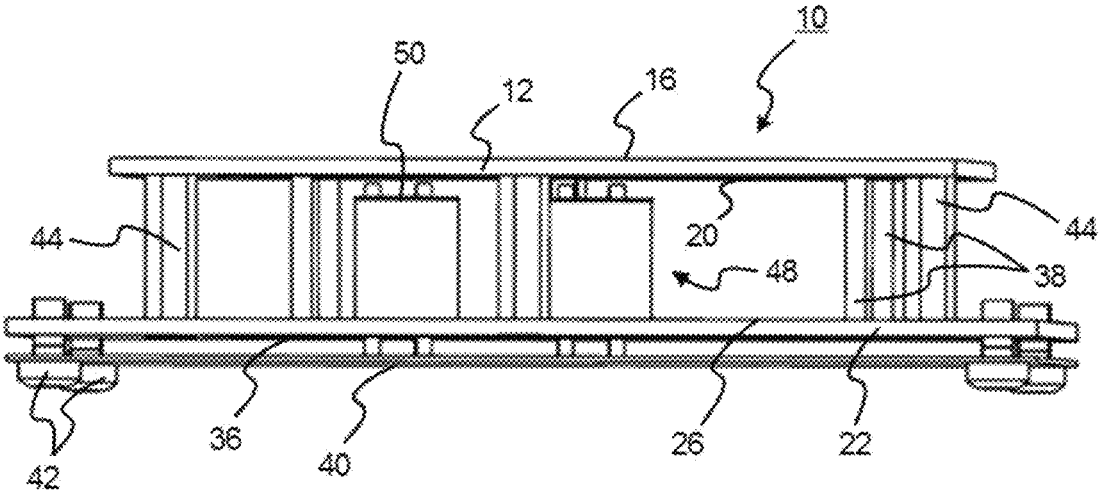
FIG. 1C is a schematic side view of the antenna system of FIG. 1A.
Figure 1D:
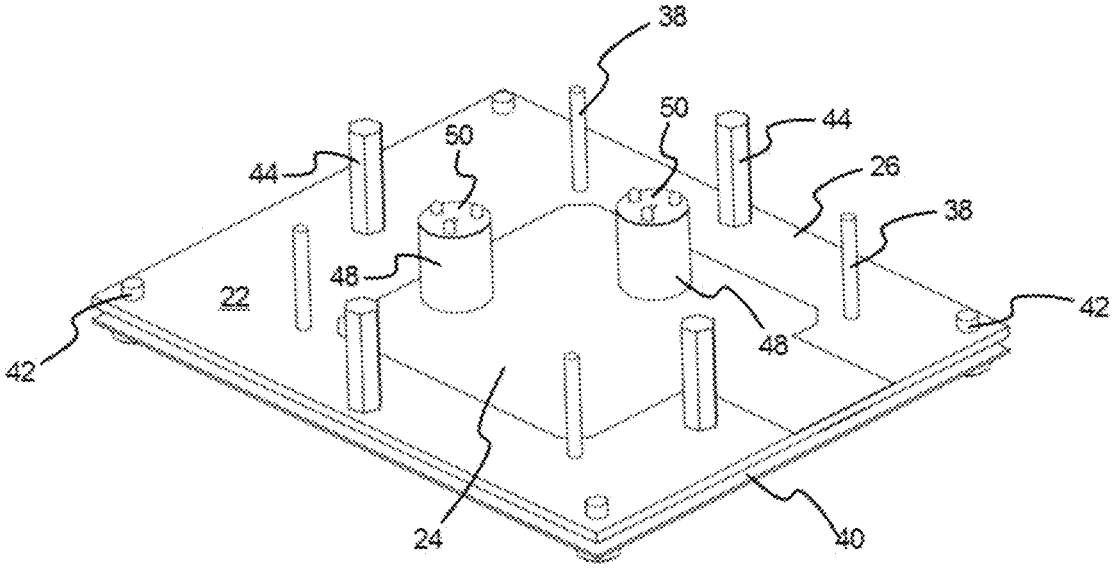
FIG. 1D is a schematic perspective view of the antenna system of FIG. 1A without a first substrate.
Figure 1E:
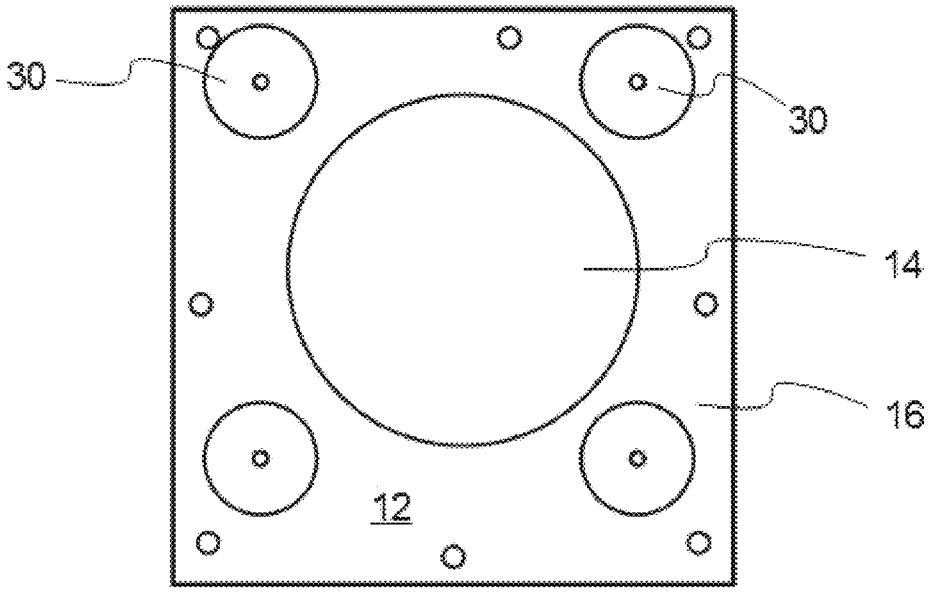
FIG. 1E is a schematic plan view of a first surface of the first substrate of the antenna system of FIG. 1A.
Figure 1F:
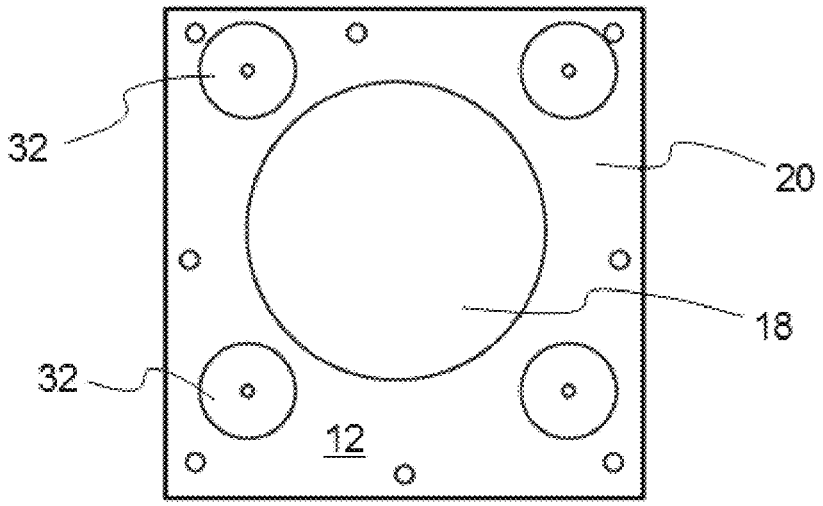
FIG. 1F is a schematic plan view of a second surface of the first substrate of the antenna system of FIG. 1A.
Figure 1G:
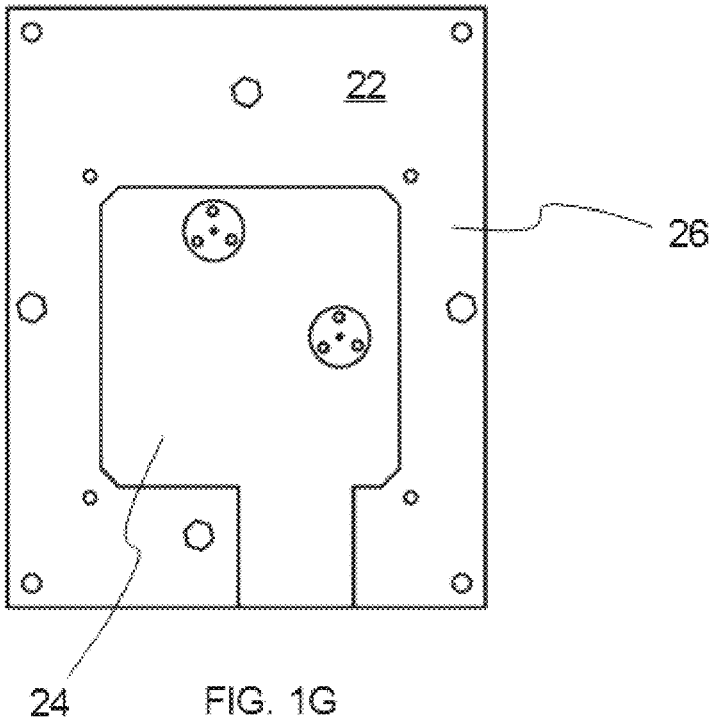
FIG. 1G is a schematic plan view of a first surface of a second substrate of the antenna system of FIG. 1A.
Figure 1H:
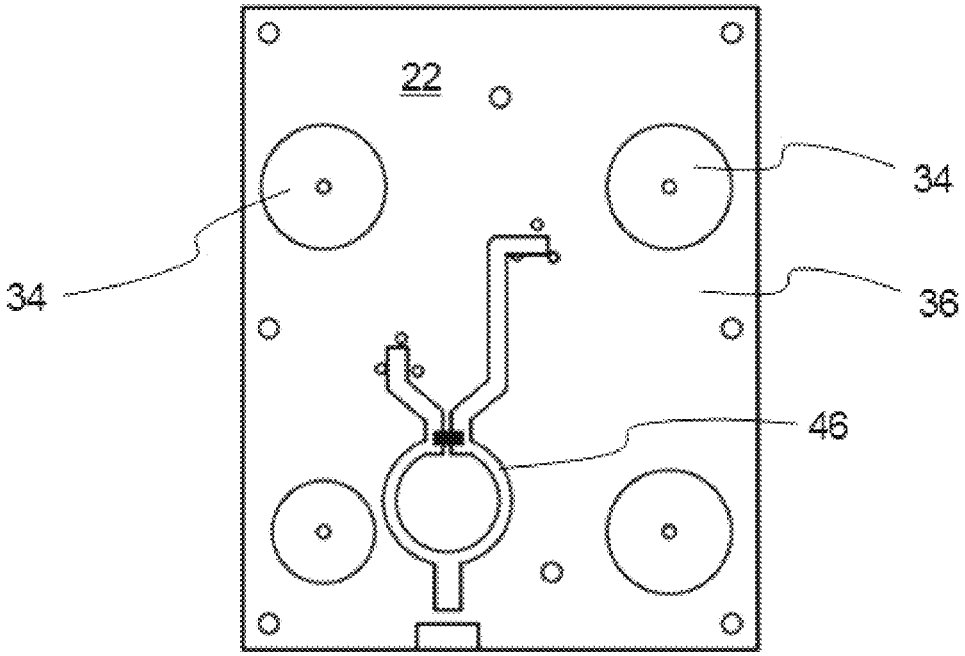
FIG. 1H is a schematic plan view of a second surface of the second substrate of the antenna system of FIG. 1A.
Figure 1I:
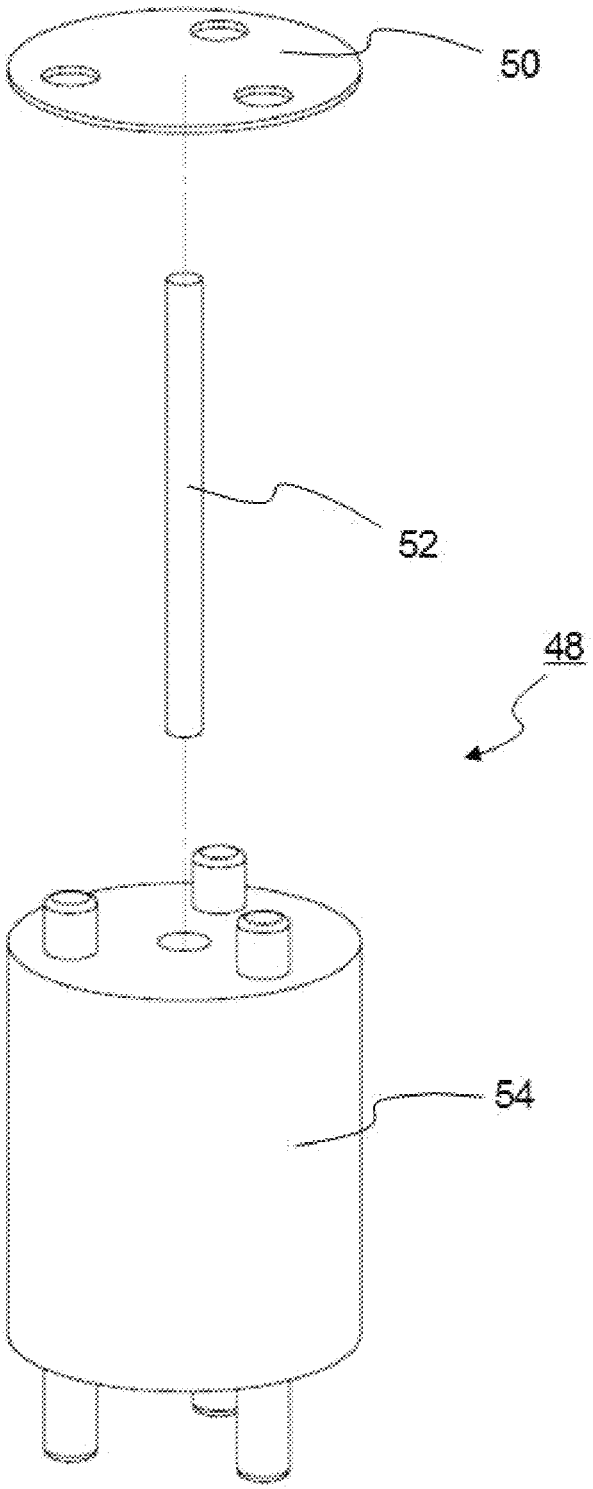
FIG. 1I is an enlarged exploded schematic perspective view of an antenna port of the antenna system of FIG. 1A.

The detailed description set forth below in connection with the appended drawings is intended as a description of presently preferred embodiments and is not intended to represent the only forms in which the present invention may be practiced. It is to be understood that the same or equivalent functions may be accomplished by different embodiments that are intended to be encompassed within the scope of the claims.

Referring now to FIGS. 1A through 1I, an antenna system 10 is shown. The antenna system 10 includes a first substrate 12, the first substrate 12 being a dielectric substrate. A first patch 14 is provided on a first surface 16 of the dielectric substrate 12 and a second patch 18 is provided on a second surface 20 of the dielectric substrate 12, the first and second patches 14 and 18 being coupled to form a first capacitor with the dielectric substrate 12. A second substrate 22 is coupled to the first or dielectric substrate 12, and a ground layer 24 is provided on a first surface 26 of the second substrate 22. An antenna feed 28 is coupled to the second substrate 22.

The first and second substrates 12 and 22 may be antenna boards. The dielectric substrate 12 may be made of a commercially available low-loss laminate material with dielectric constant of about 3.0 such as, for example, Roger 3003 and RT/Duroid 6002.

The first and second patches 14 and 18 on the first substrate or antenna board 12 form a main radiating antenna. In the embodiment shown, the first and second radiating patches 14 and 18 are circular in shape and are centrally located on the dielectric substrate 12. Nevertheless, as will be appreciated by those of ordinary skill in the art, the first and second patches 14 and 18 are not limited to being circular in shape or centrally located and may take on other shapes and/or be positioned at a different location in alternative embodiments.

The ground layer or plane 24 helps to enhance antenna gain.

In the embodiment shown, a plurality of first parasitic elements 30 is provided on the first surface 16 of the dielectric substrate 12 and a plurality of second parasitic elements 32 is provided on the second surface 20 of the dielectric substrate 12, the first and second parasitic elements 30 and 32 being coupled to form a plurality of second capacitors with the dielectric substrate 12. More particularly, each of the first parasitic elements 30 on the first surface or top side 16 of the dielectric substrate 12 is coupled with a corresponding one of the second parasitic elements 32 on the second surface or bottom side 20 of the dielectric substrate 12 to form a capacitance with dielectric constant of the first antenna board 12. Advantageously, the center radiating circular patch 14 and four (4) first parasitic elements 30 on the top side 16 of the first antenna board 12 help to enhance beam width of the antenna system 10.

A plurality of third parasitic elements 34 may be provided on a second surface 36 of the second substrate 22, the third parasitic elements 34 being electrically connected to the second capacitors. In the embodiment shown, a plurality of first rods 38 electrically connects the second capacitors to the third parasitic elements 34. The first rods 38 may be made of copper. Thus connected, the first, second and third parasitic elements 30, 32, and 34 form comprehensive sets of parasitic element pairs. Advantageously, the parasitic antenna elements 30, 32, and 34 incorporated into the antenna structure 10 help to increase angular beam width coverage. In the present embodiment, four (4) comprehensive sets of the parasitic element pairs are formed.

The first and second patches 14 and 18 and the first, second and third parasitic elements 30, 32, and 34 may be printed on the respective first and second surfaces 16, 20, 26, and 36 of the first and second substrates 12 and 22.

To enhance antenna gain, a reflector 40 may be attached to the second surface or bottom 36 of the second substrate 22. The reflector 40 may be secured at a gap distance of 2 millimeters (mm) to a bottom of the second antenna board 22 with a plurality of screws 42. The reflector 40 may be made of copper and may be of similar or same dimensions as the second antenna board 22. The screws 42 may be M3 screws.

In the embodiment shown, a plurality of spacers or standoffs 44 maintains a separation between the first and second substrates 12 and 22. The first antenna board 12 and the second antenna board 22 are supported by the spacers or standoffs 44. In this manner, the spacers 44 between the first and second substrates 12 and 22 are used to stack the two (2) antenna boards 12 and 22. The spacers 44 may be steel hex standoffs.

A power divider or combiner 46 may be electrically connected to the antenna feed 28. The antenna feed 28 may include an aperture-coupled feeding network having a plurality of antenna ports 48, the power divider or combiner 46 being configured to equally split an input power between the antenna ports 48 or combine the input power from the antenna ports 48. The power divider or combiner 46 may be a Wilkinson power divider or combiner. In the present embodiment, two (2) feeding networks are shown, the feeding networks being excited by the equally split Wilkinson power divider or combiner 46 with reference to the ground plane 24. In transmission mode, the power divider 46 may equally split the input power into half-power in magnitude and may exhibit a 90 degrees phase difference between two (2) antenna ports 48 to yield a circular polarization in the radiation pattern. In reception mode, the power combiner 46 may combine the input power, thereby doubling the power, and may exhibit a 90 degrees phase difference between two (2) antenna ports 48.

Each of the antenna ports or aperture-coupled feedings 48 may include a radiating element 50 electrically connected to the power divider or combiner 46. The radiating element 50 may be electrically connected to the power divider or combiner 46 by a second rod 52. Each of the antenna ports 48 may further include an enclosure 54 housing the second rod 52 and securing the radiating element 50 to the second substrate 22. The radiating element 50 may be a thin circular dish, the second rod 52 may be made of copper, and the enclosure 54 may be a hollow plastic cylinder. The plastic enclosure 54 may be utilized to secure the circular dish 50 to make the antenna structure more stable and secure and the copper rod 52 may be used to connect the circular dish 50 to the second antenna board 22.

The antenna system 10 of the present embodiment includes two (2) aperture-coupled feeds 48 between two (2) stacked-antenna boards 12 and 22, two (2) radiating patches 14 and 18 on opposite sides of the first antenna board 12, twelve (12) parasitic elements 30, 32, and 34 on surfaces of the stacked-antenna boards 12 and 22 and a reflector 40. In the present embodiment, the antenna system 10 is excited by the two aperture-coupled feedings 48 coupled with the twelve (12) parasitic elements 30, 32 and 34. Advantageously, the configuration of the two (2) radiating circular patches 14 and 18 printed at the center of the first antenna board 12 and the twelve (12) parasitic elements 30, 32 and 34 on the two antenna boards 12 and 22 yields a wide beam width radiation pattern and polarizes in a Right-Hand Circularly Polarized (RHCP) propagation. Nevertheless, as will be appreciated by those of ordinary skill in the art, embodiments herein are not limited by the numbers of radiating patches and/or parasitic elements in the antenna structure. In alternative embodiments, the antenna system described herein may include multiple radiating patches, various arrays of parasitic elements, a larger number of parasitic elements and/or various dielectric materials for the antenna boards.

EXAMPLES

The antenna system 10 was simulated and performance was verified using full-wave electromagnetics Computer Aided Design (CAD) simulation tools, specifically, CST Microwave Studio. The simulation results are shown in FIGS. 2 through 9B described below.

Figure 2:
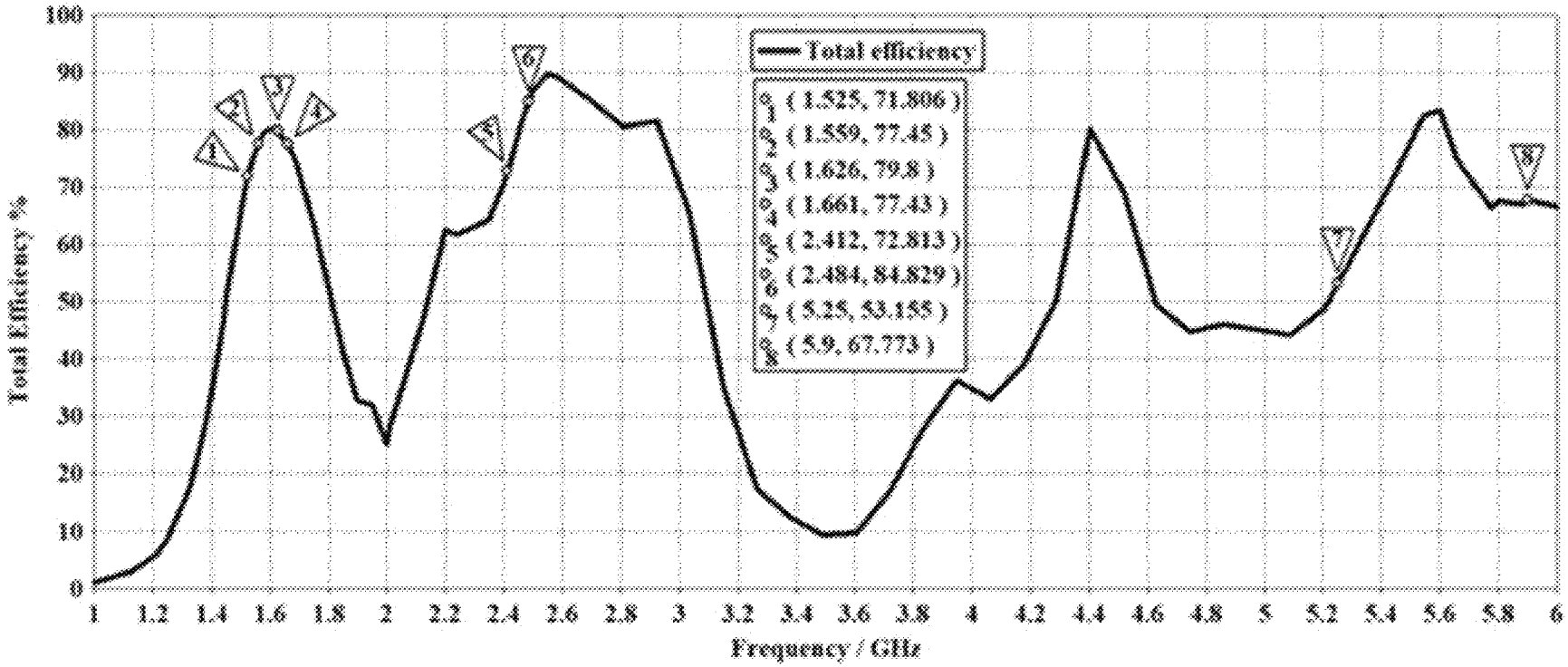
FIG. 2 is a graph of antenna efficiency against frequency.

Referring now to FIG. 2, total efficiency of the antenna system against frequency is shown. As can be seen from FIG. 2, a typical efficiency of 70% is observed across the satellite communication bands for receiving (Rx): 1525 megahertz (MHz) to 1559 MHz, and transmitting (Tx): 1626.5 MHz to 1660.5 MHz and an efficiency range of between 60% and 78% is observed across the WiFi 2.4 gigahertz (GHz) and 5 GHz bands from 2412 MHz to 2484 MHz and 5250 MHz to 5900 MHz, respectively.

Figure 3:
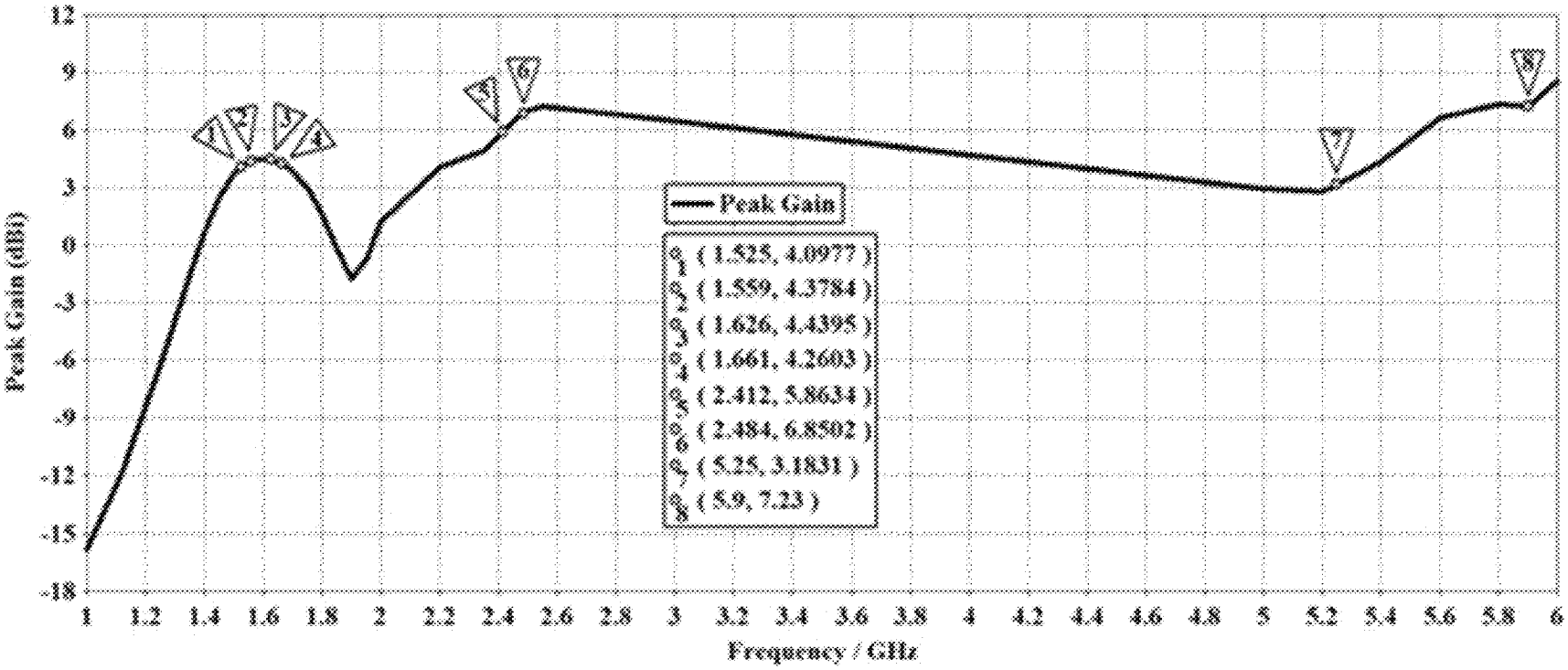
FIG. 3 is a graph of antenna peak gain against frequency.

Referring now to FIG. 3, peak gain of the antenna system against frequency is shown. As can be seen from FIG. 3, a typical of gain of 4.2 decibels-isotropic (dBi) to 7 dBi is observed across the satellite communication bands and the WiFi 2.4 GHz and 5 GHz bands.

Figure 4:
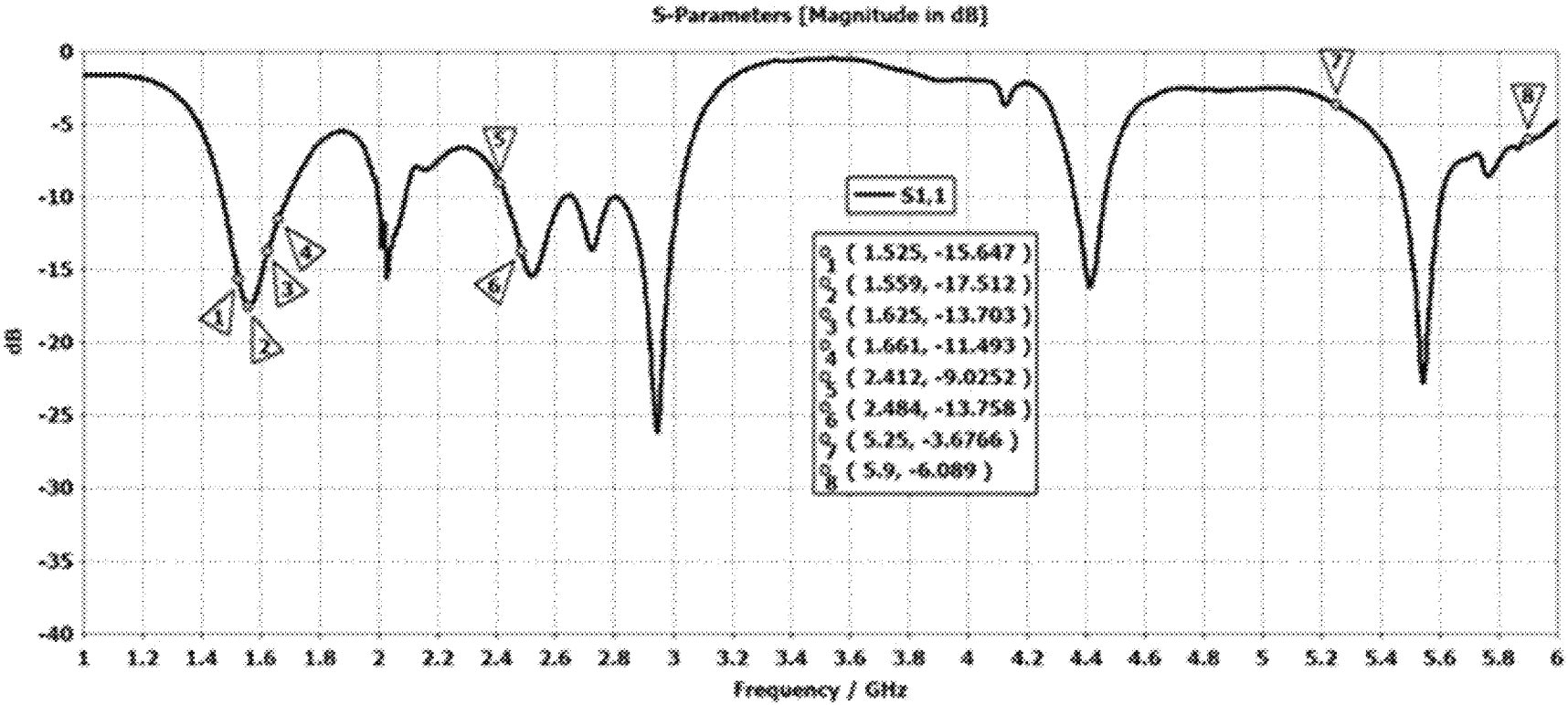
FIG. 4 is a graph of antenna return loss against frequency.

Referring now to FIG. 4, return loss in decibels (dB) of the antenna system 10 is simulated across frequency from 1 GHz to 6 GHz to cover both satellite and WiFi bands. The simulation results show that return loss of −7 dB to −15 dB range is achieved.

Figure 5:
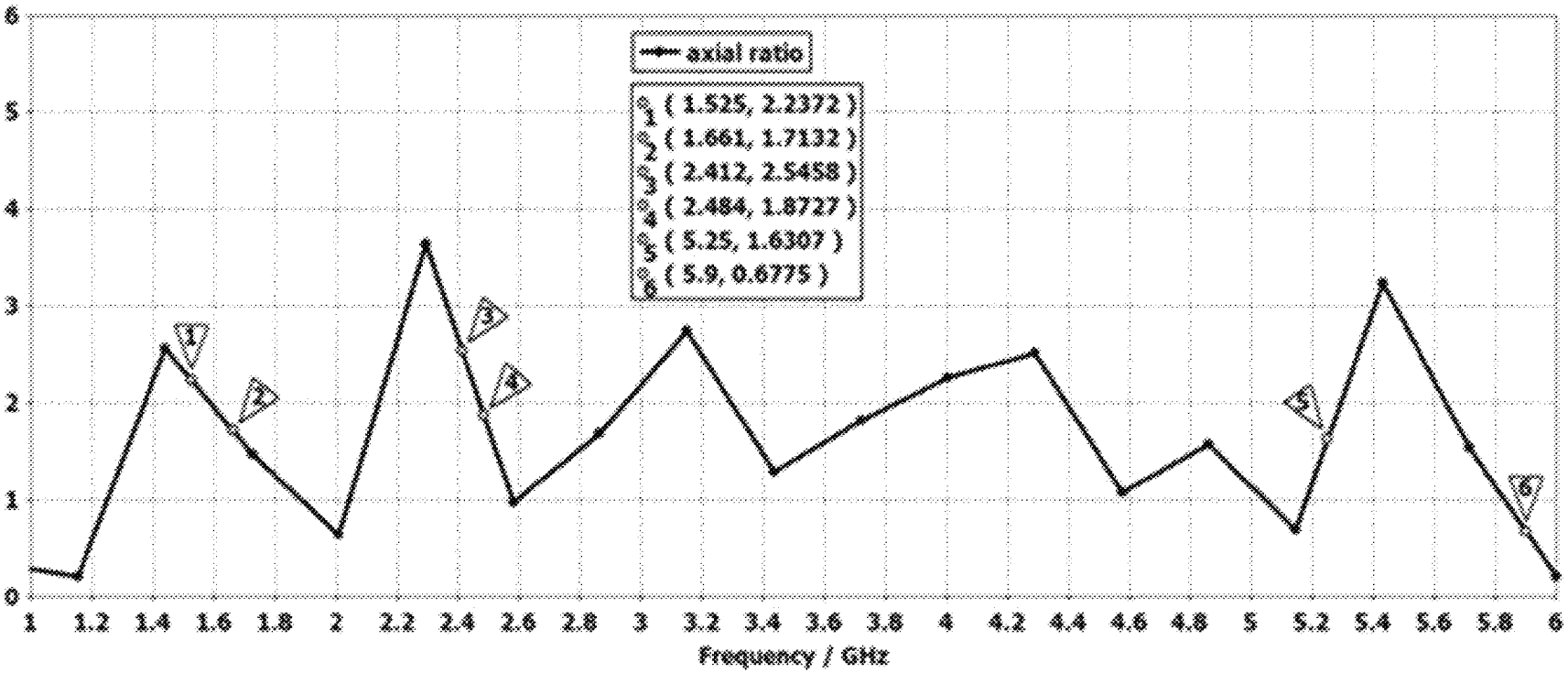
FIG. 5 is a graph of antenna axial ratio at broadside against frequency.

Referring now to FIG. 5, the axial ratio (AR) in dB at elevation angle of phi set to 90 degrees)(° of the antenna system 10 is simulated across frequency from 1 GHz to 6 GHz. The simulation results show that the AR in both the satellite and WiFi bands is below 3 dB, which indicates that the polarization of the antenna system 10 is defined as circular polarized.

A summary of the simulation results is shown in Table 1 below.

TABLE 1

| Communications | Satellite Rx | Satellite Tx | BT/WiFi 2.4G | WiFi 5G |
|---|---|---|---|---|
| Frequency (MHz) | 1525-1559 | 1625.5-1660.5 | 2412-2484 | 5250-5900 |
| Return Loss (dB) | −15 | −12 | −12 | −7 |
| Total Efficiency (%) | 74 | 78 | 78 | 60 |
| Peak Gain (dBi) | 4.2 | 4.3 | 6.2 | 5.1 |
| Axial Ratio (dB) | 2.09 | 1.9 | 1.8 | 3.2 |

FIGS. 6 through 9B are two-dimensional (2D) polar plots and three-dimensional (3D) radiation patterns of the antenna system 10 from the simulation results.

Figure 6:
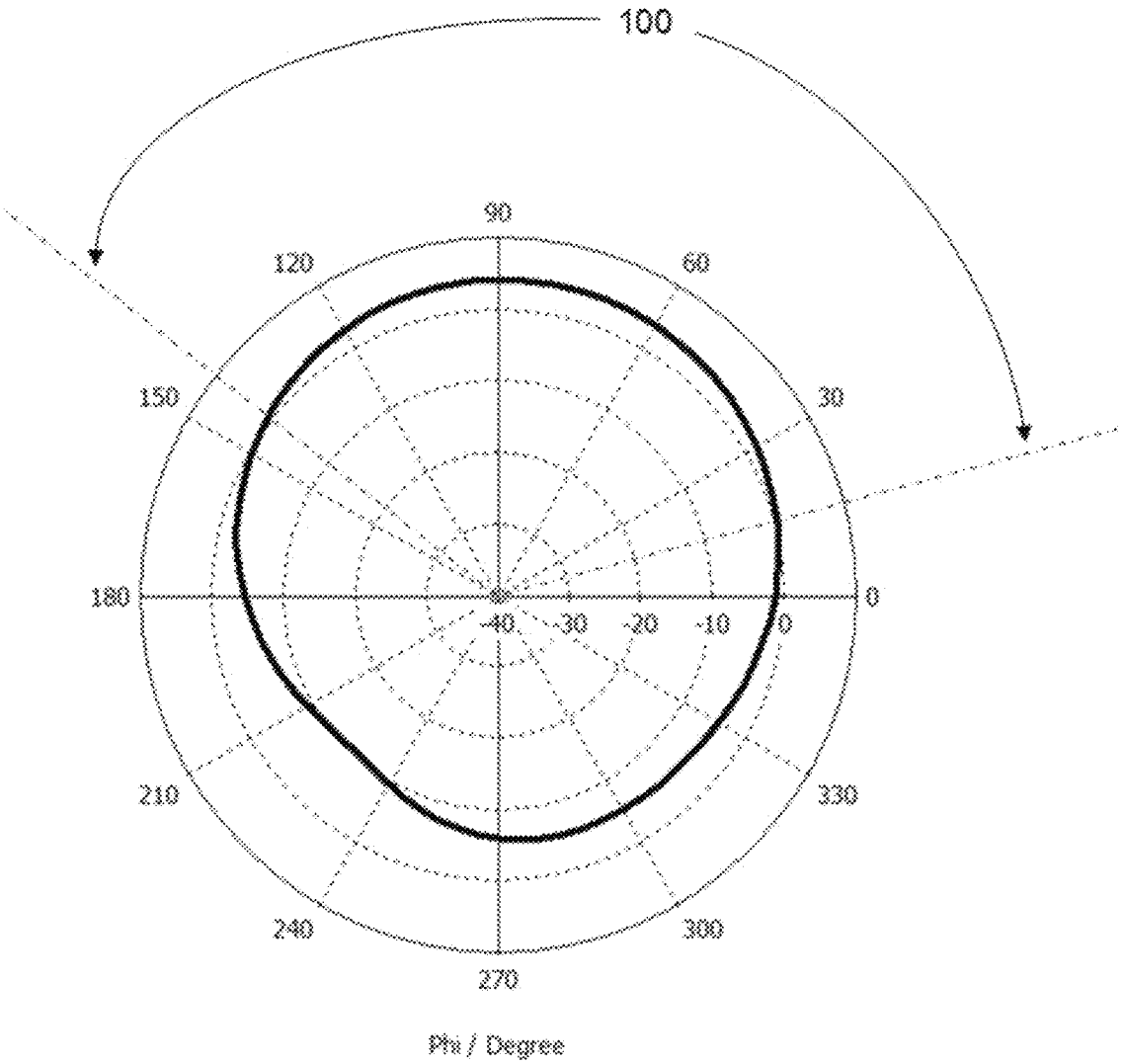
FIG. 6 illustrates a radiation pattern of an antenna system in accordance with an embodiment herein.

Referring now to FIG. 6, a two-dimensional radiation pattern plot for realized gain of the antenna system against angular phi angle with theta fixed at 90 degrees)(° and frequency at 1.661 GHz is shown. A Half-Power Beam Width (HPBW) 100 was defined to measure the metric of the antenna system with wide beam width and the HPBW of the antenna system was found to be 120° at 1.661 GHz.

Figure 7A:
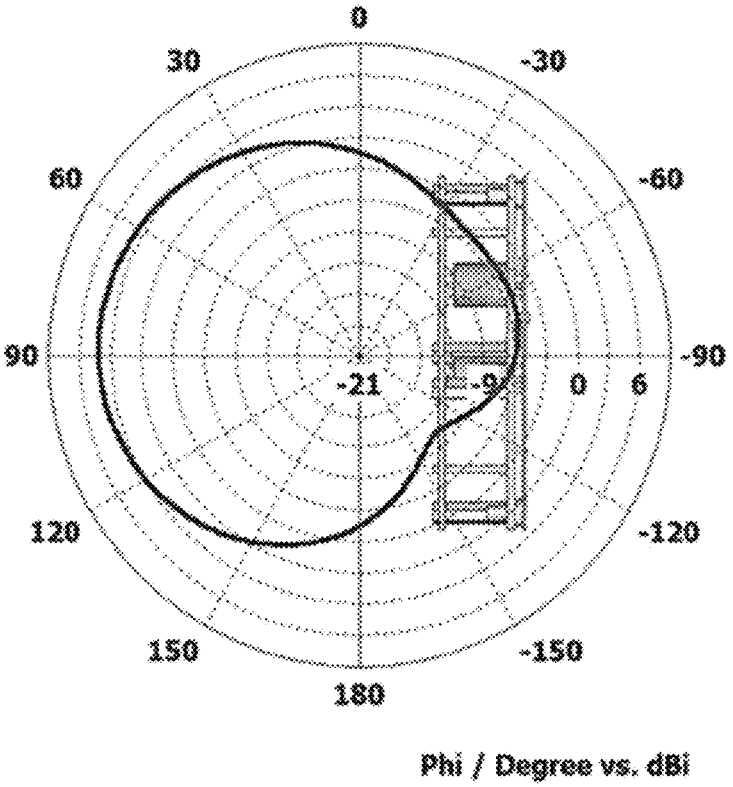
FIGS. 7A and 7B illustrate radiation patterns of an antenna system at a frequency of 1661 megahertz (MHz) in accordance with an embodiment herein.

Referring now to FIG. 7A, a two-dimensional radiation pattern plot in the XY plane of realized gain against angular phi angle with theta fixed at 90 degrees)(° and frequency targeted at 1.661 GHz overlapping with the antenna system 10 is shown.

Figure 7B:
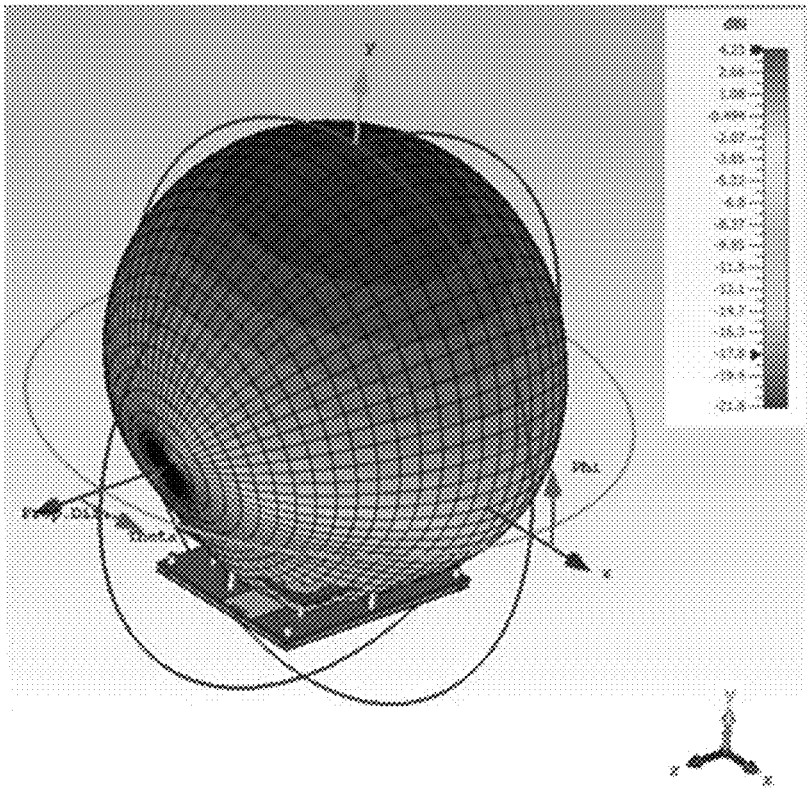

Referring now to FIG. 7B, a three-dimensional radiation pattern plot overlapping with the antenna system 10 is shown.

Figure 8A:
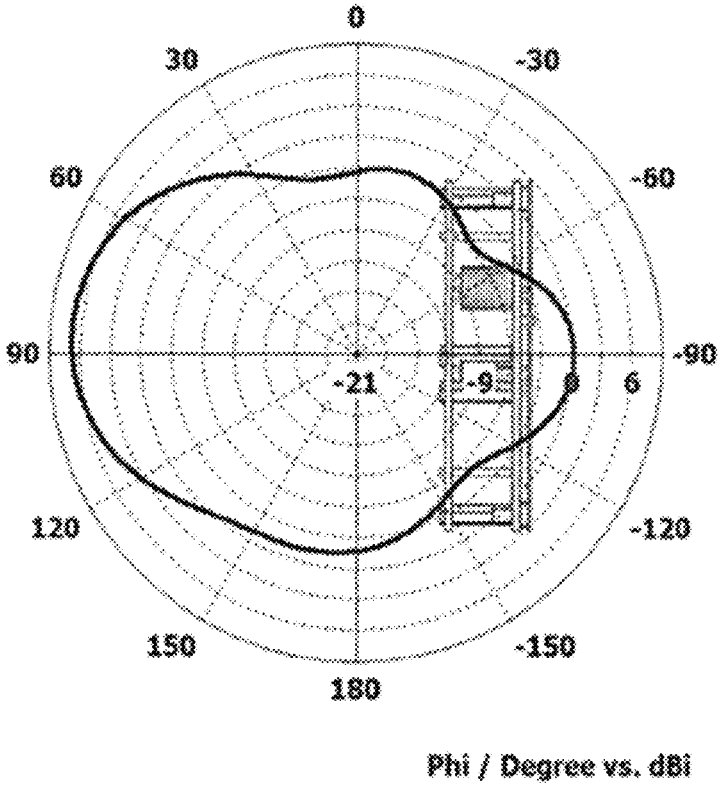
FIGS. 8A and 8B illustrate radiation patterns of an antenna system at a frequency of 2480 MHz in accordance with another embodiment herein.

Referring now to FIG. 8A, a two-dimensional radiation pattern plot in the XY plane of realized gain against angular phi angle with theta fixed at 90 degrees)(° and frequency targeted at 2.480 GHz overlapping with the antenna system 10 is shown.

Figure 8B:
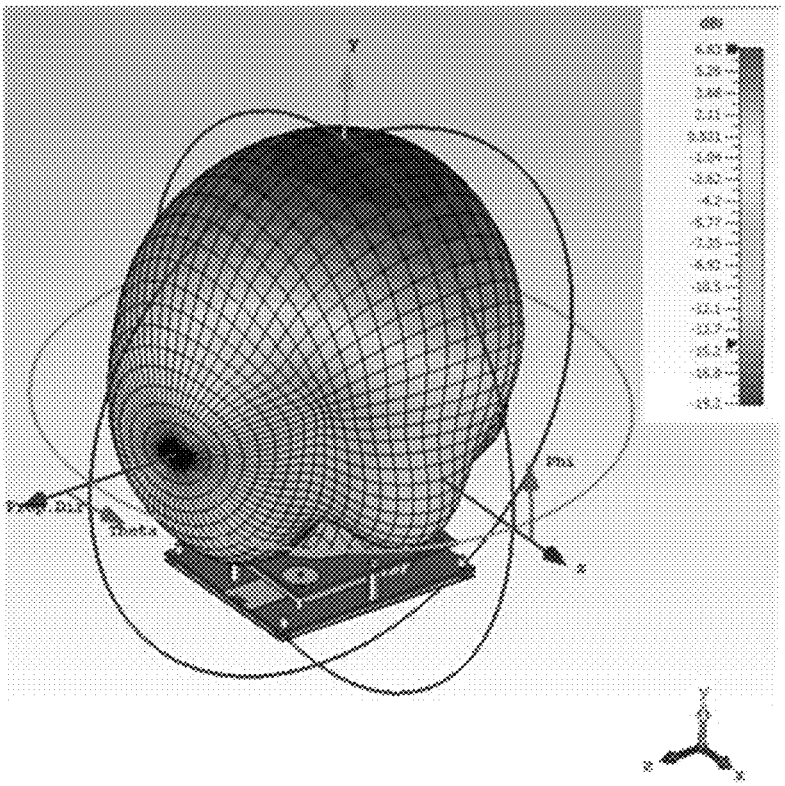

Referring now to FIG. 8B, a three-dimensional radiation pattern plot overlapping with the antenna system 10 is shown.

Figure 9A:
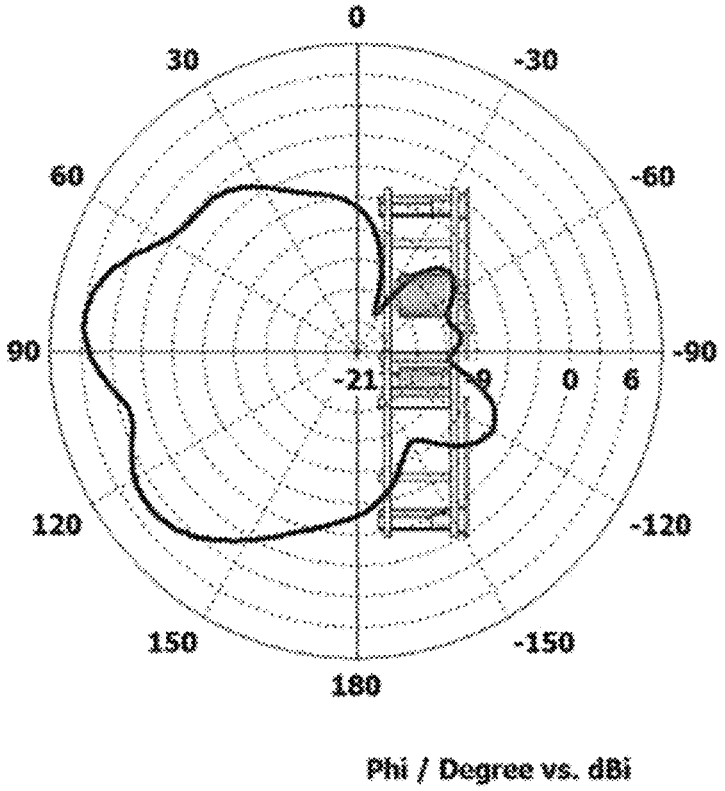
FIGS. 9A and 9B illustrate radiation pattern of an antenna system at a frequency of 5900 MHz in accordance with yet another embodiment herein.

Referring now to FIG. 9A, a two-dimensional radiation pattern plot in the XY plane of realized gain against angular phi angle with theta fixed at 90 degrees)(° and frequency targeted at 5.900 GHz overlapping with the antenna system 10 is shown.

Figure 9B:
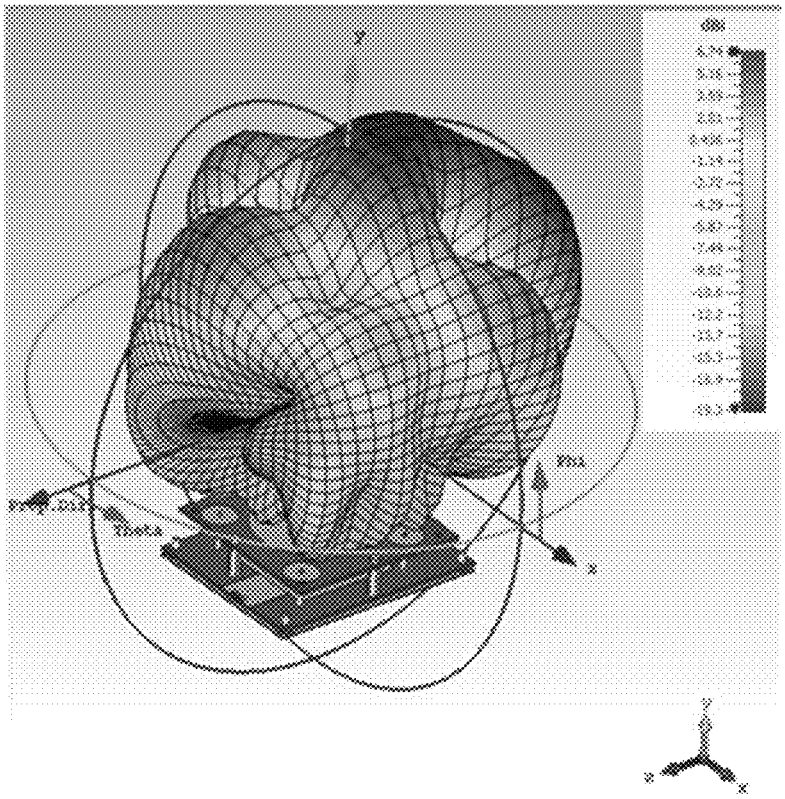

Referring now to FIG. 9B, a three-dimensional radiation pattern plot overlapping with the antenna system 10 is shown.

The simulation results show that the antenna system 10 can achieve a wide angular beamwidth of 120°, RHCP across wide frequency bands and high antenna gain with a peak gain range of from 4 dBi to 7 dBi, and provide wideband coverage of frequency bands from 1470 MHz to 1700 MHz, 2400 MHz to 3000 MHz and 5250 MHz to 5900 MHz.

As is evident from the foregoing discussion, embodiments herein provide an antenna system with multiband capability and ultra-wide beamwidth. Advantageously, the antenna system may be used for satellite navigation (Rx: 1525 MHz to 1559 MHz, and Tx: 1626.5 MHz to 1660.5 MHz), Beidou (1559 MHz to 1563 MHz), Gallileo (1559 MHz to 1591 MHz), GLONASS (1589 MHz to 1606 MHz), GPS L1 (1575 MHz), WiFi dual-band 2.4G/5 GHz communications, and Bluetooth 2.4 GHz communications.

Items Listing

Embodiments of the present disclosure include at least following items, which are not intended to limit the scope of the disclosure as a whole or of the appended claims.

Item 1: An antenna system, comprising: a first substrate, the first substrate being a dielectric substrate; a first patch on a first surface of the dielectric substrate; a second patch on a second surface of the dielectric substrate, wherein the first and second patches are coupled to form a first capacitor with the dielectric substrate; a second substrate coupled to the first substrate; a ground layer on a first surface of the second substrate; and an antenna feed coupled to the second substrate.

Item 2: The antenna system of Item 1, further comprising: a plurality of first parasitic elements on the first surface of the dielectric substrate; a plurality of second parasitic elements on the second surface of the dielectric substrate, wherein the first and second parasitic elements are coupled to form a plurality of second capacitors with the dielectric substrate;

Item 3: The antenna system of Item 2, further comprising: a plurality of third parasitic elements on a second surface of the second substrate, wherein the third parasitic elements are electrically connected to the first and second parasitic elements.

Item 4: The antenna system of Item 3, further comprising: a reflector attached to the second surface of the second substrate.

Item 5: The antenna system of any one of the preceding Items, further comprising: a plurality of spacers maintaining a separation between the first and second substrates.

Item 6: The antenna system of any one of the preceding Items, further comprising a power divider or combiner electrically connected to the antenna feed, wherein the antenna feed comprises a plurality of antenna ports and wherein the power divider or combiner is configured to equally split an input power between the antenna ports or combine the input power from the antenna ports.

Item 7: The antenna system of Item 6, wherein the power divider or combiner is a Wilkinson power divider or combiner.

Item 8: The antenna system of Item 6 or 7, wherein each of the antenna ports comprises a radiating element electrically connected to the power divider or combiner.

Item 9: The antenna system of Item 8, wherein the radiating element is electrically connected to the power divider or combiner by a rod.

Item 10: The antenna system of Item 9, wherein each of the antenna ports further comprises an enclosure housing the rod and securing the radiating element to the second substrate.

While embodiments have been illustrated and described, it will be clear that the invention is not limited to the described embodiments only. Numerous modifications, changes, variations, substitutions and equivalents will be apparent to those skilled in the art without departing from the scope of the invention as described in the claims. The antenna system of the present invention may be used in marine telematics applications for ship-to-ship, ship-to-port and ship-to-satellite navigation and communications.

Further, unless the context clearly requires otherwise, throughout the description and the claims, the words "comprise," "comprising," and the like are to be construed in an inclusive as opposed to an exclusive or exhaustive sense; that is to say, in the sense of "including, but not limited to."

What is claimed is:

1. An antenna system, comprising:

a first substrate, the first substrate being a dielectric substrate;

a first patch on a first surface of the dielectric substrate;

a plurality of first parasitic elements on the first surface of the dielectric substrate;

a second patch on a second surface of the dielectric substrate, wherein the first and second patches are coupled to form a first capacitor with the dielectric substrate;

a plurality of second parasitic elements on the second surface of the dielectric substrate, wherein the first and second parasitic elements are coupled to form a plurality of second capacitors with the dielectric substrate;

a second substrate coupled to the first substrate;

a ground layer on a first surface of the second substrate; and an antenna feed coupled to the second substrate.

2. The antenna system of claim 1, further comprising a plurality of third parasitic elements on a second surface of the second substrate, wherein the third parasitic elements are electrically connected to the second capacitors.

3. The antenna system of claim 2, further comprising a reflector attached to the second surface of the second substrate.

4. The antenna system of claim 1, further comprising a plurality of spacers maintaining a separation between the first and second substrates.

5. The antenna system of claim 1, further comprising a power divider or combiner electrically connected to the antenna feed, wherein the antenna feed comprises a plurality of antenna ports and wherein the power divider or combiner is configured to equally split an input power between the antenna ports or combine the input power from the antenna ports.

6. The antenna system of claim 5, wherein the power divider or combiner is a Wilkinson power divider or combiner.

7. The antenna system of claim 5, wherein each of the antenna ports comprises a radiating element electrically connected to the power divider or combiner.

8. The antenna system of claim 7, wherein the radiating element is electrically connected to the power divider or combiner by a rod.

9. The antenna system of claim 8, wherein each of the antenna ports further comprises an enclosure housing the rod and securing the radiating element to the second substrate.

* * * * *